US008926146B2

(12) United States Patent
Alfier et al.

(10) Patent No.: US 8,926,146 B2
(45) Date of Patent: Jan. 6, 2015

(54) MOUNTING DEVICE FOR LIGHTING SOURCES

(71) Applicant: Osram AG, Munich (DE)

(72) Inventors: Alberto Alfier, Vedelago (IT); Simon Bobbo, Chirignago (IT); Marco Lamonato, Crocetta del Montello/Treviso (IT); Alessandro Scordino, Dolo (IT)

(73) Assignee: Osram AG, Munich (DE)

( * ) Notice: Subject to any disclaimer, the term of this patent is extended or adjusted under 35 U.S.C. 154(b) by 266 days.

(21) Appl. No.: 13/650,185

(22) Filed: Oct. 12, 2012

(65) Prior Publication Data

US 2013/0094229 A1 Apr. 18, 2013

(30) Foreign Application Priority Data

Oct. 13, 2011 (IT) ..... TO2011A0911

(51) Int. Cl.

| | |
|---|---|
| ***F21V 21/00*** | (2006.01) |
| ***F21V 29/00*** | (2006.01) |
| ***F21V 19/00*** | (2006.01) |
| ***F21V 23/06*** | (2006.01) |
| *F21V 17/12* | (2006.01) |
| *F21Y 101/02* | (2006.01) |

(52) U.S. Cl.

CPC ..... *F21V 19/0035* (2013.01); *F21V 29/22* (2013.01); *F21V 23/06* (2013.01); *F21V 17/12* (2013.01); *F21Y 2101/02* (2013.01)

USPC ..... 362/382; 362/389

(58) Field of Classification Search

USPC ..... 362/382, 389

See application file for complete search history.

(56) References Cited

U.S. PATENT DOCUMENTS

| | | | | |
|---|---|---|---|---|
| 5,233,773 | A * | 8/1993 | Reynolds | 362/369 |
| 2007/0109806 | A1 | 5/2007 | Tsukamoto et al. | |
| 2011/0069502 | A1 | 3/2011 | Hum | |

FOREIGN PATENT DOCUMENTS

| | | | |
|---|---|---|---|
| WO | 2007128070 | A1 | 11/2007 |

* cited by examiner

*Primary Examiner* — David V Bruce

(57) ABSTRACT

A device for mounting lighting sources on a substrate includes a mounting frame provided with fixing formations for fixing on the substrate, the mounting frame defining a cavity for receiving the lighting source which rests on the substrate. A locking member may be provided which can be positioned in the cavity of the mounting frame to urge said lighting source toward the substrate. At least one of the mounting frame and the locking member may include at least one retaining formation for the lighting source, including one or more pins extending into corresponding openings in the lighting source, and/or one or more elastic fins extending from the mounting frame to elastically contact the lighting source.

10 Claims, 5 Drawing Sheets

MOUNTING DEVICE FOR LIGHTING SOURCES

CROSS-REFERENCE TO RELATED APPLICATION

This application claims priority to Italian Patent Application Serial No. TO2011A000911, which was filed Oct. 13, 2011 and is incorporated herein by reference in its entirety.

TECHNICAL FIELD

Various embodiments relate to devices for mounting lighting sources. More particularly, various embodiments may relate to devices for mounting LED lighting sources, for example of the type referred to as Chip-on-Board (CoB).

BACKGROUND

For mounting a lighting source on a substrate it is possible to use a system with screws to ensure mechanical contact, but this has the drawback that it does not allow uniform distribution of the pressure.

As a result, the thermal interface properties and the heat transfer are not constant on the contact surface and may easily deteriorate over time.

SUMMARY

Various embodiments disclose facilitating the mounting of a lighting source, for example an LED lighting source arranged on a dedicated PCB card, on a substrate such as, for example, a heat sink capable of constituting an integral part of the lighting system ("luminaire").

According to various embodiments, this object is achieved as disclosed and as recited in the claims which follow, the claims forming an integral part of the technical teaching provided here.

Various embodiments may have one or more exemplary features. For example, the lighting source may have an associated support member, for example a frame, with a central hole or cavity which surrounds the lighting source.

By further example, a locking member in the form of a slider can be provided for locking, pressing and protecting the lighting source, said member having an upper opening in order to allow correct manipulation by the user.

By further example, the lighting source and the slider member may have interference pins.

By further example, the external support member or frame may have one or more elastic fins distributed over the perimeter so as to contain the lighting source inserted therein, maintaining the possibility of free expansion and compression within the frame owing to the heat cycles.

By further example, it may be possible for elastic members to be provided so as to press the lighting source resiliently against a substrate, such as a heat sink, By further example, it may be possible for screws or rivets to be provided for connecting the external frame to the support, such as a heat sink.

By further example, the external support may have a plurality of ramp-like guides on the external surface thereof, By further example, the slider member may be provided with extruded pins capable of cooperating with the ramp-like openings.

By further example, the frame or shell may have an opening which leaves a connector for the connection of cables exposed.

In various embodiments, the coupling of the lighting source with the locking member (for example a slider member) is facilitated by the presence of interference pins, which allow mechanical connection; it is then possible to continue with fixing on the substrate (for example a heat sink), with the subsequent positioning of the slider member intended for keeping the lighting source in contact.

BRIEF DESCRIPTION OF THE DRAWINGS

In the drawings, like reference characters generally refer to the same parts throughout the different views. The drawings are not necessarily to scale, emphasis instead generally being placed upon illustrating the principles of the invention. In the following description, various embodiments of the invention are described with reference to the following drawings, in which.

DETAILED DESCRIPTION

In the following description, various specific details aimed at providing a fuller understanding of the embodiments are explained. The embodiments may be implemented without one or more of the specific details or using other methods, components, materials, etc. In other cases, known structures, materials or operations are not shown or described in detail so that various aspects of the embodiments may be understood more clearly.

The reference to "an embodiment" in the context of this description indicates that a particular configuration, structure or feature described in relation to the embodiment is included in at least one embodiment. Therefore, phrases such as "in one embodiment", which may occur at various points in this description, do not necessarily refer to the same embodiment. Moreover, particular forms, structures or features may be combined in any suitable manner in one or more embodiments.

The reference signs used here are provided solely for the sake of convenience and therefore do not define the scope of protection or ambit of the embodiments.

Figure 1:
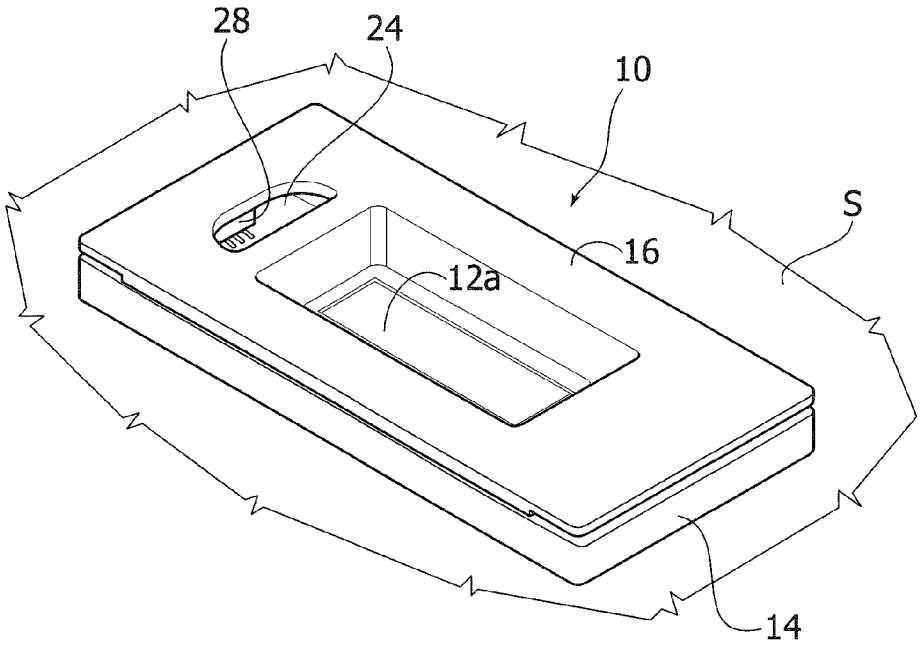
FIG. 1 is a general perspective view of one embodiment.
Figure 2:
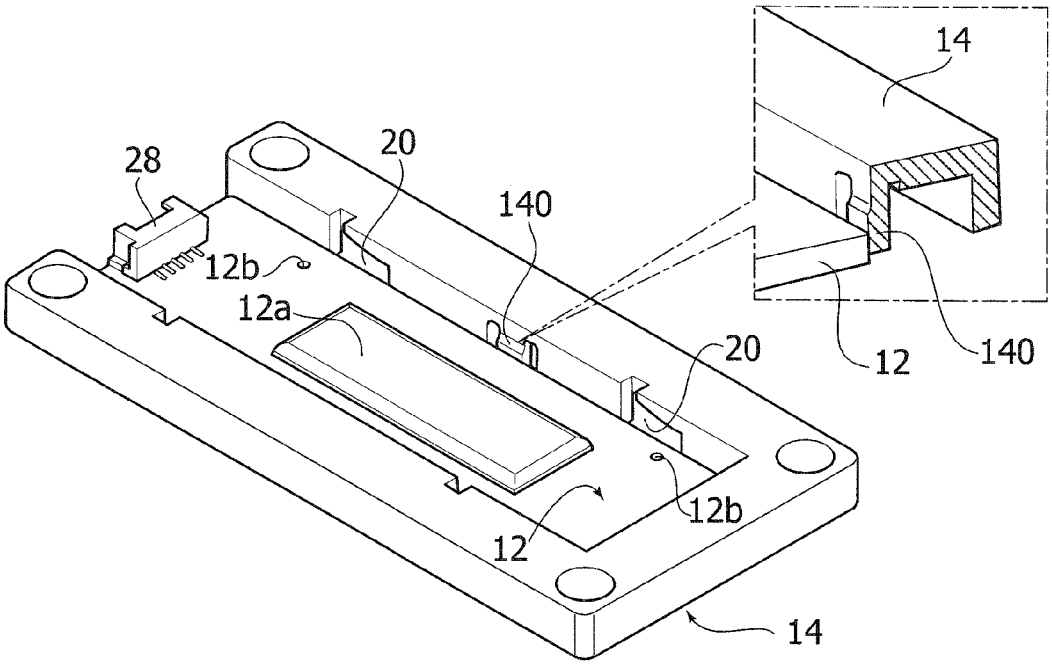
FIG. 2 is a perspective and partial cross-sectional view illustrating a component embodiment.
Figure 3:
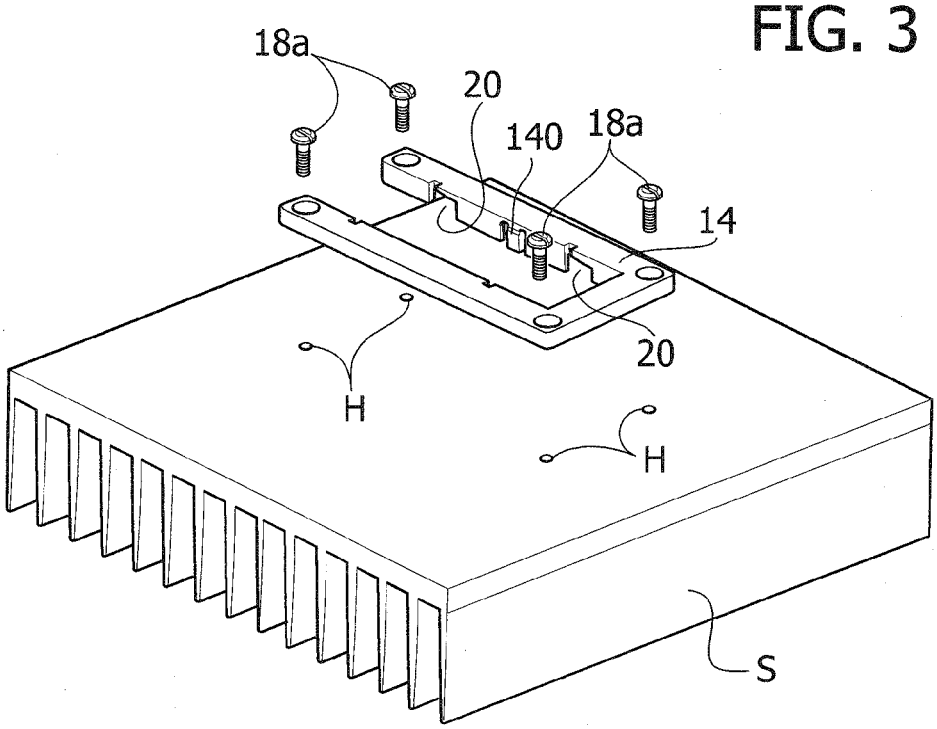
FIG. 3 is a perspective view illustrating the mounting of a component embodiment.
Figure 4:
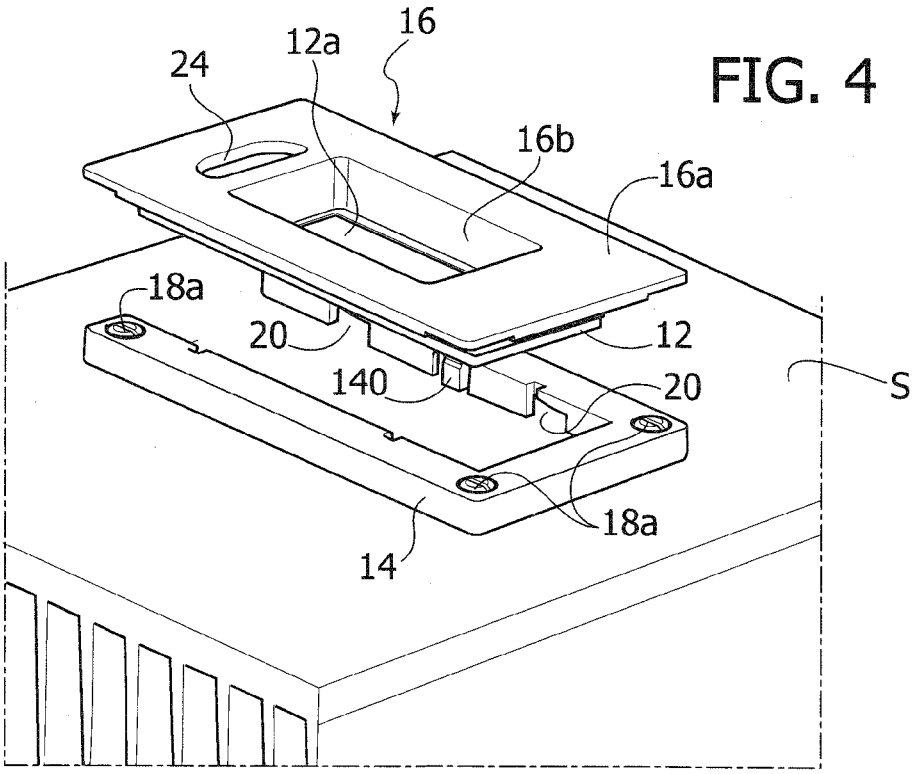
FIG. 4 is a perspective view illustrating the mounting of an e component embodiment.

FIGS. 1 and 4 show the combined features of various embodiments of a device, denoted as a whole by 10, which makes it possible for a lighting source 12 to be mounted on a substrate S.

In various embodiments, the substrate S may be constituted by a heat sink or by the body of a lighting device ("luminaire") of any known type, not expressly visible in the figures.

In various embodiments, the lighting source 12 may be constituted by an LED light radiation source. In various embodiments, it may be an LED lighting source implemented according to the solution known as Chip-on-Board or CoB.

In various embodiments, the lighting source 12 may be a planar lighting source, for example in the form of a board in which there is an active portion 12*a* (for example LED) constituting the actual lighting source.

As can be seen more clearly in the exploded perspective view in FIG. 4, in various embodiments the lighting source 12 may be mounted on the substrate S with a device including a mounting frame 14 and a sliding member or slider 16.

As can be seen more clearly by observing FIGS. 1 to 4, in various embodiments the frame 14 may have a general channel-like shape and define, internally, a cavity in which the lighting source 12 may be mounted resting on the surface S, as can be seen more clearly by observing FIG. 1.

Figure 5:
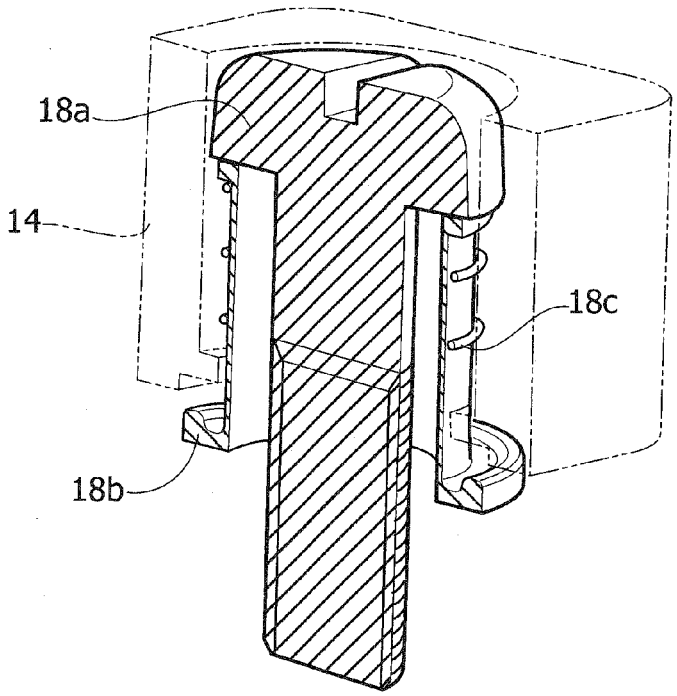
FIG. 5 is a cross-sectional view of a component embodiment.

In various embodiments, the frame 14 may be fixed on the substrate S by means of fixing formations which, in various embodiments, may include (see in particular FIG. 5) a screw or rivet 18*a* capable of extending from the frame 14 to engage a corresponding opening H (for example a threaded hole) provided on the surface of the substrate S.

Likewise, in various embodiments, frame 14 may be fixed on substrate S by means of fixing formations which, in various embodiments, may include (see FIG. 5) a bushing 18*b* fitted on the screw or rivet 18*a* and acting as a guide member for a resilient member 18*c,* which can be constituted, in various embodiments, by a helical spring fitted around the bushing 18*b.*

Whichever the specific embodiment adopted (for example, the spring 18*c* could be fitted directly on the screw or rivet 18*a,* or could be substituted by an equivalent resilient member, such as an elastic sleeve), the fixing formations described make it possible for the frame 14 to be mounted on the substrate S with the possibility to regulate the force with which the frame 14 is urged against said substrate S.

This result can be obtained by regulating and/or appropriately selecting the features of resilience of the resilient member, such as the spring 18*c.*

In various embodiments, it is moreover possible to select the thickness or height of the frame 14 such that, when it is fixed on the substrate S, the frame 14 remains at a distance from the surface of the substrate S (see for example the distance d shown in FIG. 10), so that it does not make contact with the surface of the substrate S.

This solution is advantageous for achieving uniform distribution of the force exerted (according to the methods described in more detail hereinbelow) on the lighting source 12 to make it rest on the substrate S.

Figure 6:
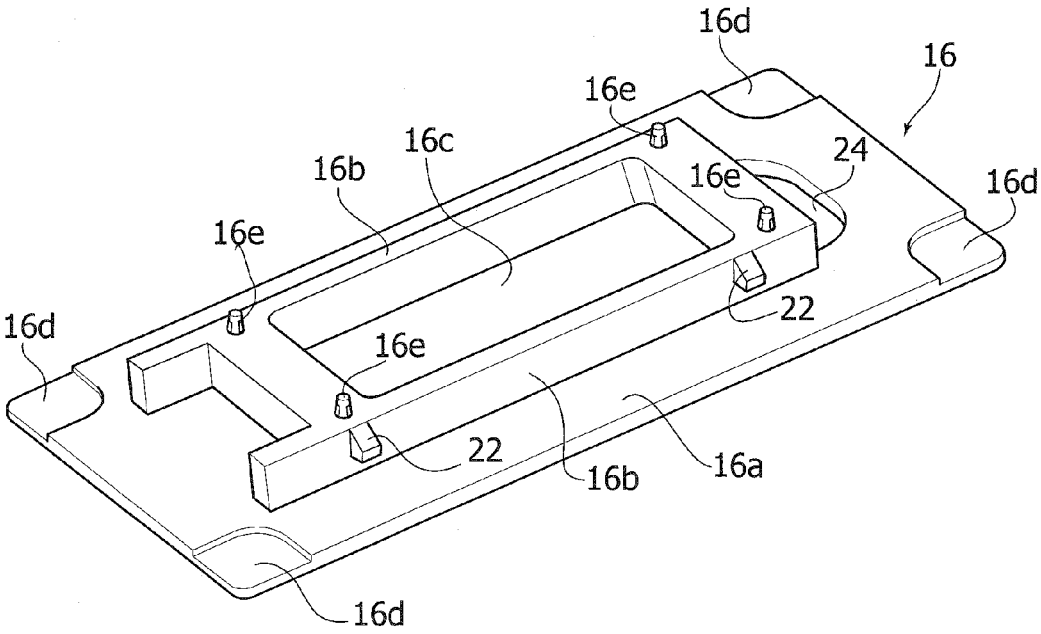
FIG. 6 is a perspective view of a component embodiment.
Figure 7:
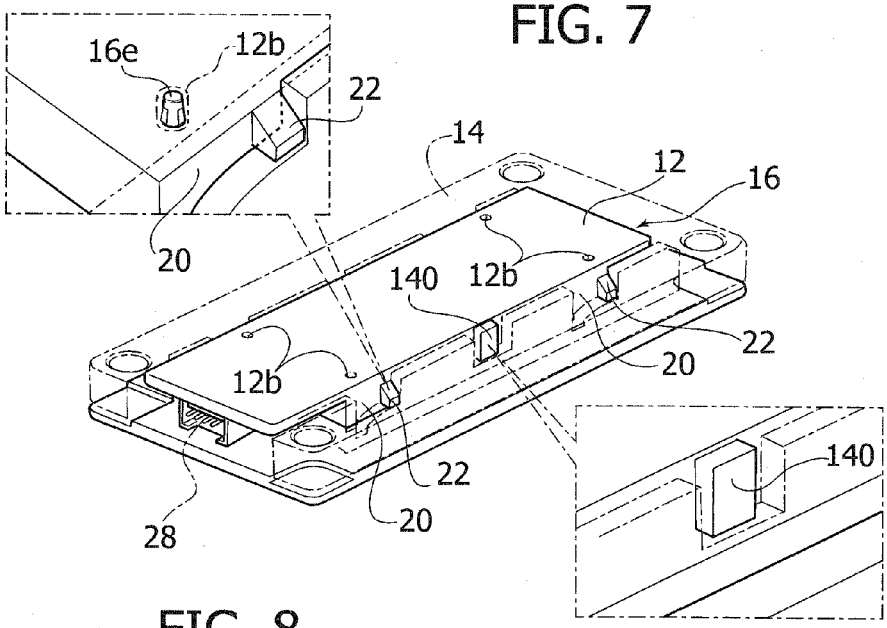
FIG. 7 is a perspective view of various details of a component embodiment.

As can be seen more clearly in the view in FIG. 6, the general channel-like shape of the frame 14 may be comparable with a corresponding, at least partial channel-like shape of the slider 16.

In various embodiments, the slider 16 may include a web portion 16*a,* with an extent at least approximately complementary to the course of the frame 14 (for example rectangular, in the embodiments under consideration here), and two lateral branches 16*b* which are capable of giving the slider 16 a channel-like shape overall which is complementary to that of the frame 14, with the side walls 16*b* of the slider 16 positioned so as to extend within the frame 14.

The side walls 16*a* can thus press on the lighting source 12 (for example on the sides of the board which bears the active member 12*a*) so as to urge the lighting source 12 toward the position in which it rests on the substrate S.

In various embodiments, the frame 14 and the slider 16 bear complementary engagement formations intended to cooperate with one another in a ramp-like manner.

In various embodiments, the aforementioned complementary structures may include one or more ramp-like cavities 20, arranged for example on the frame 14, and/or one or more pins 22 protruding from the sides of the slider 16.

The accompanying drawings refer to exemplary embodiments which have four ramp-like cavities 20 arranged in two mutually facing pairs of cavities on the sides of the frame 14, and/or four pins 22 arranged in two pairs of facing pins on the sides 16*a* of the slider 16.

The number of complementary formations can of course differ from that under consideration here. In addition, the relative arrangement could be reversed (at least in part), with one or more cavities arranged on the slider 16 and one or more pins arranged on the frame 14.

In addition, the complementary ramp-like formations (or cam-like formations, as they may also be called) could have a different shape, it being understood that, in various embodiments, these complementary engagement formations 20, 22 can ensure that the longitudinal advancing movement of the slider 16 within the frame 14 causes the slider 16 to be forced or urged toward the surface of the substrate S.

In various embodiments, the sliding movement of the slider 16 with respect to the frame 14 may be carried out between a withdrawn insertion position (shown in FIG. 8), in which the slider 16 can be inserted in the frame 14, with the walls or lateral branches 16*b* being made to penetrate into the frame 14.

Figure 8:
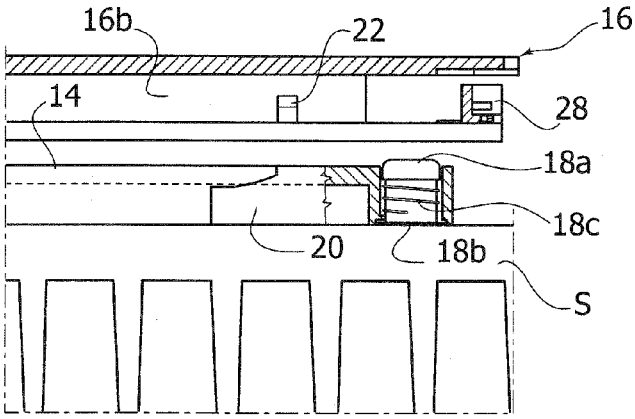
FIGS. 8-10 are side views illustrating a mounting sequence for an embodiment.
Figure 9:
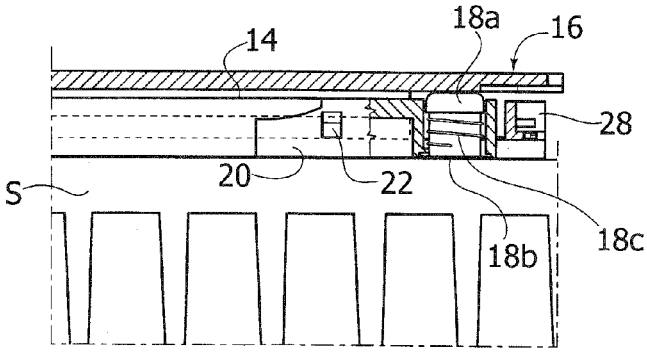
Figure 10:
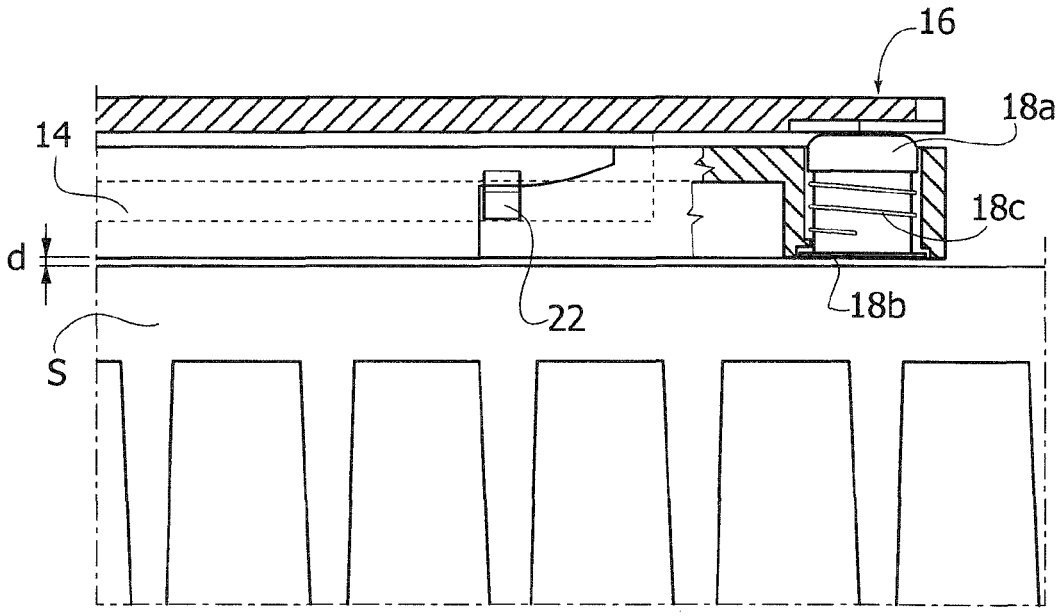

Moreover, in various embodiments, the sliding movement of slider 16 with respect to frame 14 may be carried out between an advanced locking position (see the sequence in FIGS. 9 and 10) reached by the slider 16 which, positioned in the frame 14, is made to advance within the frame 14 (with a movement from right to left, with reference to the point of observation of FIGS. 8 to 10).

Due to this longitudinal sliding movement, owing to the cooperation between the cavities 20 and the pins 22 (or of corresponding ramp-like complementary members), the slider 16 acts—in particular with the branches 16*a,* in the example under consideration here—on the lighting source 12 in the sense that it urges it toward the surface of the substrate S, into the position in which it rests on the substrate S.

In various embodiments, the slider 16 is provided with a window formation 16*c* (constituted by an opening or by a transparent portion) so as to permit propagation of the light radiation produced by the active part 12*a* and the lighting source 12 toward the outside of the device 10.

In various embodiments, the web part 16*a* of the slider 16 can have imprints 16*d* located in a position complementary to the positions occupied by the fixing formations of the frame 14 on the substrate S (for example imprints 16*d* intended to be turned toward the heads of the screws or rivets 18*a*) so as to realize coupling intended to prevent the slider 16 from accidentally sliding backward from the locking position (FIG. 10) toward the insertion position (FIG. 8).

In addition, in various embodiments the slider 16 can have an engagement formation, such as an eyelet or dimple 24, intended to make it easier to control the sliding movement and/or scraping-type electrical contacts 26 intended to reliably establish electrical contact with the lighting source 12, in particular with tracks or lines for electrical contact which are present on said lighting source (not explicitly visible in the drawings).

In various embodiments, a connector 28 mounted on the slider 16 makes it possible for the lighting source 12 to be electrically connected to a power/drive source (not explicitly shown in the drawings).

In various embodiments, the slider-type locking member 16 can be provided (for example in alignment with the lateral branches 16*b*) with pins 16*e* intended to engage corresponding openings 12*b* provided in the planar lighting source 12, for example in the board which surrounds the active member 12*a*, ensuring the exact positioning of the lighting source 12.

In addition or as an alternative to the provision of the pins 16*e* intended to engage the openings 12*b*, the positioning of the lighting source 12 within the frame 14 can be ensured on account of spring-like fins 140 intended to elastically cooperate with the sides of the lighting source 12 (typically with the sides of the board or card on which the active member 12*a* is mounted).

In various embodiments, the fin or fins 140 can face toward the side walls 16*b* of the slider member 16.

The lighting source 12 can be inserted within the frame 14 with said lighting source 12 being held in position by the elastic action of the fin or fins 140.

Then, it is possible to insert the slider member 16 according to the methods described above.

The cooperation between the pins 22 and the ramp-like openings 20 gives rise to a vertical force which presses the lighting source 12 against the substrate S, while at the same time lifting the frame 14 (distance d in FIG. 10) counter to the action of the springs 18*c*, the elastic properties of which define the corresponding modulus of the force acting on the frame 14 (and therefore through the member 16) on the light source 12.

It is possible to achieve uniform distribution of this force over the entire area of the lighting source 12, thus exerting a uniform and efficient pressure (and therefore a corresponding thermal contact resistance) over the entire lighting source.

The electrical connection between the lighting source 12 and the external power supply can be realized by means of the connector 28, which is kept accessible by means of an end opening left free from the frame 14 by the slider member 16.

Various embodiments thus make it possible for one or more of the following advantages to be achieved:

- quick and easy interchangeability of the lighting source 12, it being possible at the same time to preserve (for example owing to the pins 16*e*) a retaining effect for the lighting source,
- the possibility to install the lighting source (for example if the pins 16*a* are not used) without making it slide by means of the slider member 16; this being a solution which makes it possible to use a thermoconductive paste without incurring in effect disadvantages linked to relative sliding,
- the possibility for the user to select a module (thus of a lighting source) with dimensions greater than those which are admissible in the presence of the pins 16*a* when the fin or the fins 140 are used to retain the lighting source 12,
- the possibility to allow the thermal expansion/contraction of the lighting source 12 during the heat cycles linked to operation owing to the presence of the spring-like fin or fins 140,
- the possibility to exchange the lighting source 12 without having to loosen screws,
- the possibility to achieve an extremely uniform pressure on the contact surface between the lighting source 12 and the substrate S, particularly when a heat sink is involved, obtaining an optimum thermal connection,
- the possibility to regulate the pressure generated on the lighting source, depending on the thermal requirements, by means of the regulation/selection of the features of the springs 18*c*.

While the invention has been particularly shown and described with reference to specific embodiments, it should be understood by those skilled in the art that various changes in form and detail may be made therein without departing from the spirit and scope of the invention as defined by the appended claims. The scope of the invention is thus indicated by the appended claims and all changes which come within the meaning and range of equivalency of the claims are therefore intended to be embraced.

The invention claimed is:

1. A device for mounting lighting sources on a substrate, comprising:

a mounting frame provided with fixing formations for fixing on said substrate, said mounting frame defining a cavity for receiving said lighting source with said lighting source resting on said substrate, a locking member which can be positioned in said cavity of said mounting frame to urge said lighting source toward said substrate, wherein at least one of said mounting frame and said locking member includes at least one retaining formation for said lighting source, wherein said retaining formation includes at least one of:

at least one pin extending into a corresponding opening in said lighting source, and at least one elastic fin extending from said mounting frame to elastically contact said lighting source.

2. The device as claimed in claim 1, wherein said locking member bears a connector for electrical contact with said lighting source, said connector being exposed when said locking member is positioned in said mounting frame.

3. The device as claimed in claim 1, wherein said mounting frame has a channel-like shape, and wherein said locking member is a member slidable with respect to said mounting frame between an insertion position and a locking position, wherein said mounting frame and said slider member bear complementary engagement formations cooperating in a ramp-like manner to force said slider member and the lighting source urged thereby toward said substrate when said slider member is advanced from said insertion position toward said locking position.

4. The device as claimed in claim 3, wherein said complementary engagement formations further comprise:

at least one ramp-like cavity, and at least one pin engaging said at least one ramp-like cavity, said ramp-like cavity and said pin being carried by said mounting frame and by said slider member, respectively.

5. The device as claimed in claim 1, wherein said fixing formations comprise at least one resilient member which resiliently forces said mounting frame toward said substrate.

6. The device as claimed in claim 5, wherein said resilient member includes a spring.

7. The device as claimed claim 1, wherein said fixing formations include screws or rivets extending between said mounting frame and said substrate.

8. The device as claimed in claim 1, wherein said locking member has lateral branches extending into the cavity of said mounting frame to urge said lighting source toward said substrate.

9. The device as claimed in claim 1, wherein said locking member comprises a window portion permitting propagation of the light radiation produced by said lighting source.

10. The device as claimed in claim 1, wherein said substrate is a heat sink.

* * * * *